US005836461A

United States Patent [19]

Kokenge et al.

[11] Patent Number: 5,836,461

[45] Date of Patent: Nov. 17, 1998

[54] WIRE SHELF

[75] Inventors: Elmer J. Kokenge; William Carlson; Stephen R. Egolf; John D. Kokenge, all of Cincinnati, Ohio

[73] Assignee: Schulte Corporation, Cincinnati, Ohio

[21] Appl. No.: 781,477

[22] Filed: Jan. 10, 1997

[51] Int. Cl.[6] ..... A47F 5/00

[52] U.S. Cl. ..... 211/153; 211/90.03; 211/105.1; 108/181

[58] Field of Search ..... 211/90.01, 90.03, 211/106, 181.1, 105.1, 153; 108/181, 29

[56] References Cited

U.S. PATENT DOCUMENTS

| | | |
|---|---|---|
| D. 266,130 | 9/1982 | Gimmi et al. . |
| D. 275,434 | 9/1984 | Taub . |
| D. 280,280 | 8/1985 | Pestone . |
| D. 287,202 | 12/1986 | Trubiano . |
| D. 323,439 | 1/1992 | Emery . |
| D. 324,783 | 3/1992 | Greenhut et al. . |
| D. 341,283 | 11/1993 | Rosenthal . |
| D. 349,000 | 7/1994 | Rogers et al. . |
| D. 352,195 | 11/1994 | Rogers et al. . |
| D. 354,864 | 1/1995 | Kokenge et al. . |
| 505,360 | 9/1893 | Hillard . |
| 1,004,996 | 10/1911 | Collis . |
| 1,391,495 | 9/1921 | Parsons . |
| 1,486,773 | 3/1924 | McClain . |
| 1,576,784 | 3/1926 | Planett . |
| 2,271,784 | 2/1942 | Tritt . |
| 2,612,273 | 9/1952 | Smith . |
| 2,788,885 | 4/1957 | Begent . |
| 2,859,879 | 11/1958 | Rogers et al. . |
| 2,870,916 | 1/1959 | LaBonia et al. . |
| 3,120,309 | 2/1964 | Goettl et al. . |
| 3,141,556 | 7/1964 | Klosterman . |
| 3,225,940 | 12/1965 | Story . |
| 3,688,915 | 9/1972 | Ramsey . |
| 3,978,799 | 9/1976 | Escalette . |
| 4,316,593 | 2/1982 | Miner et al. . |
| 4,361,099 | 11/1982 | Kokenge et al. . |
| 4,493,423 | 1/1985 | Kaeslin et al. . |
| 4,553,523 | 11/1985 | Stoherer, Jr. . |
| 4,671,419 | 6/1987 | Beverly . |
| 4,717,104 | 1/1988 | Lee . |
| 4,762,238 | 8/1988 | Blanchard . |
| 4,783,035 | 11/1988 | Remmers . |
| 4,825,504 | 5/1989 | Camilleri . |
| 4,884,702 | 12/1989 | Rekow . |
| 5,050,750 | 9/1991 | Mason . |
| 5,104,080 | 4/1992 | Berger . |
| 5,325,973 | 7/1994 | Reedy . |
| 5,335,794 | 8/1994 | Reedy . |
| 5,350,072 | 9/1994 | Rogers et al. . |
| 5,355,810 | 10/1994 | Camilleri . |
| 5,373,951 | 12/1994 | Arnold . |
| 5,405,026 | 4/1995 | Lee et al. . |
| 5,531,416 | 7/1996 | Remmers ..... 211/105.1 X |
| 5,626,245 | 5/1997 | Kokenge et al. . |

FOREIGN PATENT DOCUMENTS

| | | |
|---|---|---|
| 1251070 | of 1960 | France . |
| 2562777 | of 1985 | France . |
| 2007991 | of 1971 | Germany . |
| 164969 | of 1957 | Sweden . |

OTHER PUBLICATIONS

Lee/Rowan Company, Free Slide & Tight Mesh Shelving, 1992, No. 10602.

Schulte, Take A Closer Look At The Schulte Difference, pp. 1–32, 1993.

On Page Advertisement for Superslide Wire Shelving System from CloseMaid.

*Primary Examiner*—Robert W. Gibson, Jr.

*Attorney, Agent, or Firm*—Dinsmore & Shohl LLP

[57] ABSTRACT

A wire shelf having a hanger rod which permits uninterrupted hanger travel along its length, said shelf comprising. The hanger rod is secured to either the front support rod or an intermediate support rod by a plurality of support hooks. Each support hook has an end secured to the support rod, and another end secured to the hanger rod.

24 Claims, 3 Drawing Sheets

WIRE SHELF

BACKGROUND OF THE INVENTION

1. Field of the Invention

The present invention relates to a wire shelf. More particularly, the wire shelf of the present invention comprises a plurality of wire members connected to one another, wherein one of these wire members comprises a hanger rod supported beneath the remaining members. The hanger rod is supported by a plurality of support hooks such that clothes hangers may be slid along the entire length of the hanger rod without interference from the support hooks.

2. Description of Related Art

While conventional wooden shelving is often the preferred means for providing additional storage space in homes and businesses, the high cost of wood sometimes make such shelving prohibitively expensive. Thus, the use of wire rod shelving has become a viable, low-cost alternative to wooden shelving. Such wire shelving generally consists of a number of parallel, spaced transversely-extending wire rods which are welded to two or more longitudinally-extending support rods. The wire rods are typically cold drawn steel, and they may be resistance welded to one another. It is also usually preferred that the rods be coated with a hard, non-porous durable material such as epoxy. Such wire shelves are shown, for example, in FIG. 1 of U.S. Pat. No. 4,361,099, which is incorporated herein by reference. (The '099 Patent).

As shown in FIG. 1 of the '099 patent, such wire shelves typically comprise a plurality of transversely-extending, parallel, spaced rod members which form the support surface of the shelf. The transversely-extending rod members are supported at their rear ends by means of a longitudinally-extending rear support rod and at their front ends by means of another longitudinally-extending front support rod. A longitudinally-extending intermediate support rod is also often provided, wherein this intermediate support rod extends parallel and between the rear support rod and the front support rod.

In order to support clothes hangers from the shelf shown in the '099 patent, a hanger rod 13 is positioned beneath the plane of the support surface of the shelf. Typically, this hanger rod is positioned directly beneath, and extends parallel to the front support rod in order to not only simplify usage of the shelf and hanger rod, but also to provide an aesthetically-pleasing unit. In order to position the hanger rod in this manner, a plurality of support members extending between the hanger rod and the front support rod are typically provided. The chief drawback to the shelf design shown in the '099 patent with regard to the hanger rod, is that when a clothes hanger is positioned on the hanger rod, the support members will interfere with the sliding of the hanger along the entire length of the hanger rod. Thus, hanger travel along the hanger rod will be limited by the support members.

Numerous attempts have been made to overcome the above-referenced shortcoming with respect to hanger travel along the hanger rod. Specifically, U.S. Pat. No. 5,350,072 (the '072 patent, which is incorporated herein by reference) discloses one such attempt. While this patent provides a hanger rod which allows for uninterrupted hanger travel along its length, the construction of this shelf unnecessarily complicates the manufacturing process, and precludes the use of conventional shelving brackets. It is highly desirable to limit such extra expenses whenever possible. Thus, there is a need for a wire shelf which has a hanger rod permitting uninterrupted hanger travel, while also not significantly increasing the manufacturing complexity and ensuring compatibility with existing mounting hardware (such as brackets).

SUMMARY OF THE INVENTION

It is an object of the present invention to provide an improved shelf having a hanger rod which permits uninterrupted travel of a hanger thereon.

It is another object of the present invention to provide a wire shelf having a hanger rod which allows uninterrupted hanger travel thereon, while not significantly increasing the manufacturing costs associated with such a shelf.

The foregoing objects may be accomplished, in accordance with one aspect of the present invention, by providing a wire shelf having a hanger rod which permits uninterrupted hanger travel along its length, the shelf comprising:

(a) a plurality of parallel, transversely-extending rod members, each having a rear end and a forward end, the transversely-extending rod members providing a support surface and the forward end of the members positioned at a forward edge of the shelf;

(b) a longitudinally-extending rear support rod secured to the rear end of each of the transversely-extending rod members;

(c) a longitudinally-extending front support rod secured to the forward end of each of the transversely-extending rod members; and (d) at least one longitudinally-extending intermediate support rod positioned parallel to the front and rear support rods, and secured to the transversely-extending rod members;

(e) a plurality of support hooks shaped from a wire rod, the support hooks secured to one of the front support rod and the at least one intermediate support rod (i.e., secured to one or the other), each of the support hooks comprising an upper end and a lower end, the upper end secured directly to the outer circumference of one of the front support rod and the at least one intermediate support rod; and (f) a hanger rod secured to said support hooks at or adjacent to said lower end of the support hooks wherein the support hooks are configured so as to position the hanger rod beneath the plane of the support surface, and such that the hook portion of a clothes hanger may be slid along the length of the hanger rod without obstruction from the support hooks.

All of the members described above are preferably made from cold drawn steel, and may therefore be secured to one another in the orientation described by means of welding (preferably resistance welding). The support hooks each comprise a first portion which extends downwardly away from the support rod to which it is welded, and a second portion which curves towards the forward edge of the shelf and terminates in the lower end, such that the first and second portions of the support hooks provide a trough within which the end of the hook portion of a hanger resting on hanger rod will travel when the hanger is slid along the length of the hanger rod. Preferably the upper and lower ends are substantially flat and extend substantially perpendicular to the longitudinal axis of the wire rod from which the support hook is produced (usually this will be perpendicular to the longitudinal axis of the first portion of the support hook when it is straight). Preferably, the first portion of the support hooks extend downwardly and rearwardly away from the support rod to which it is welded, and thus the first portion extends away from the support surface of the shelf at an angle of less than 90 degrees (angle D in FIG. 3). The hanger rod is preferably positioned parallel to and substantially directly beneath the support rod to which the hooks are welded.

In order to improve the weld between the upper end of the support hooks and the support rod to which it is secured (both in terms of strength and aesthetics), a pair of parallel flats are preferably provided on opposite sides of the circumference of each of the support hooks adjacent the upper end such that the distance across the upper end at the flats is approximately equal to or less than the diameter of the support rod to which the upper end is welded. These same parallel flats may also be provided on opposite sides of the circumference of each of the support hooks adjacent the lower end such that the distance across the lower end at the flats is approximately equal to or less than the diameter of the hanger rod, and the lower end of the support hooks may then be welded directly to the outer circumference of the hanger rod. A second longitudinally-extending intermediate support rod positioned parallel to the front and rear support rods, and secured to the transversely-extending rod members between the rear support rod and the at least one intermediate support rod, may also be provided.

The diameter of the wire rod from which the support hooks are fabricated (i.e., the "diameter of the support hooks") is preferably greater than the diameter of the support rod to which the upper end is welded. In addition, the distance between the hanger rod and the support rod to which it is secured is preferably between about 1¼ inches and about 1⅝ inches. The diameter of the transversely-extending rod members is preferably between about 0.09 and 0.12 inches. The support rods, other than the support rod to which the support hooks are welded, preferably have a diameter of between about 0.22 inches and about 0.25 inches. The diameter of the support rod to which the support hooks are welded, as well as the diameter of the hanger rod, is preferably between about 9/32 inches and about 5/16 inches in diameter. The support hooks preferably have a diameter of between about 0.34 and about 0.38 inches in diameter. The distance between adjacent support hooks is preferably less than 9 inches.

BRIEF DESCRIPTION OF THE DRAWINGS

While the specification concludes with claims particularly pointing out and distinctly claiming the present invention, it is believed that the same will be better understood from the following description taken in conjunction with the accompanying drawings in which:

DETAILED DESCRIPTION OF THE INVENTION

Reference will now be made in detail to the presently preferred embodiments of the invention, examples of which are illustrated in the accompanying drawings, wherein like numerals indicate the same elements throughout the views.

Figure 1:
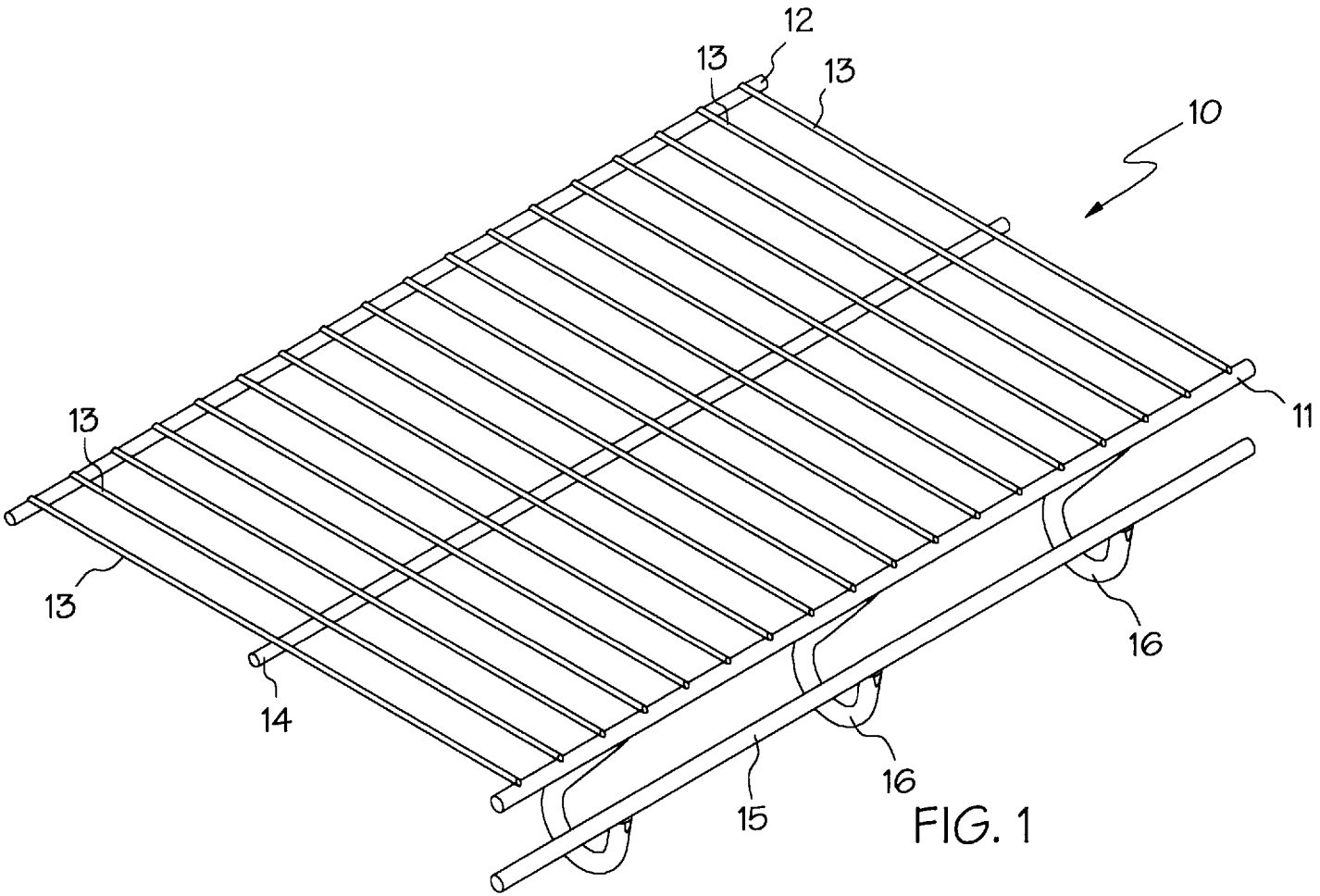
FIG. 1 is a perspective view of one embodiment of the wire shelf of the present invention.

The wire shelf of the present invention is illustrated generally at 10 in FIG. 1, and includes a plurality of transversely-extending, parallel, spaced rod members 13, which form the horizontal support surface of shelf 10. Transverse rod members 13 are supported at their rear ends by means of a longitudinally-extending rear support rod 12, and at their forward ends by means of a longitudinally-extending front support rod 11. Preferably, one or more longitudinally-extending intermediate support rods may also be provided between rear support rod 12 and front support rod 11. One of such intermediate support rods is shown at 14 in FIG. 1.

The various wire rods employed in the present invention may be made of any of a variety of materials, however cold drawn steel is preferred. Such wire rods are easy to produce and shape, and are also inexpensive and readily bonded or welded to one another. In order to provide a secure structure, the various wire rods employed in the present invention should be rigidly secured to one another. This may be accomplished by any of a variety of means, however, resistance welding is the particularly preferred method. After the wire shelf of the present invention has been fabricated, a protective coating is preferably applied to the rods. For example, an epoxy coating may be applied to the surfaces of the wire rods in order to provide a hard, non-porous, durable surface.

Figure 2:
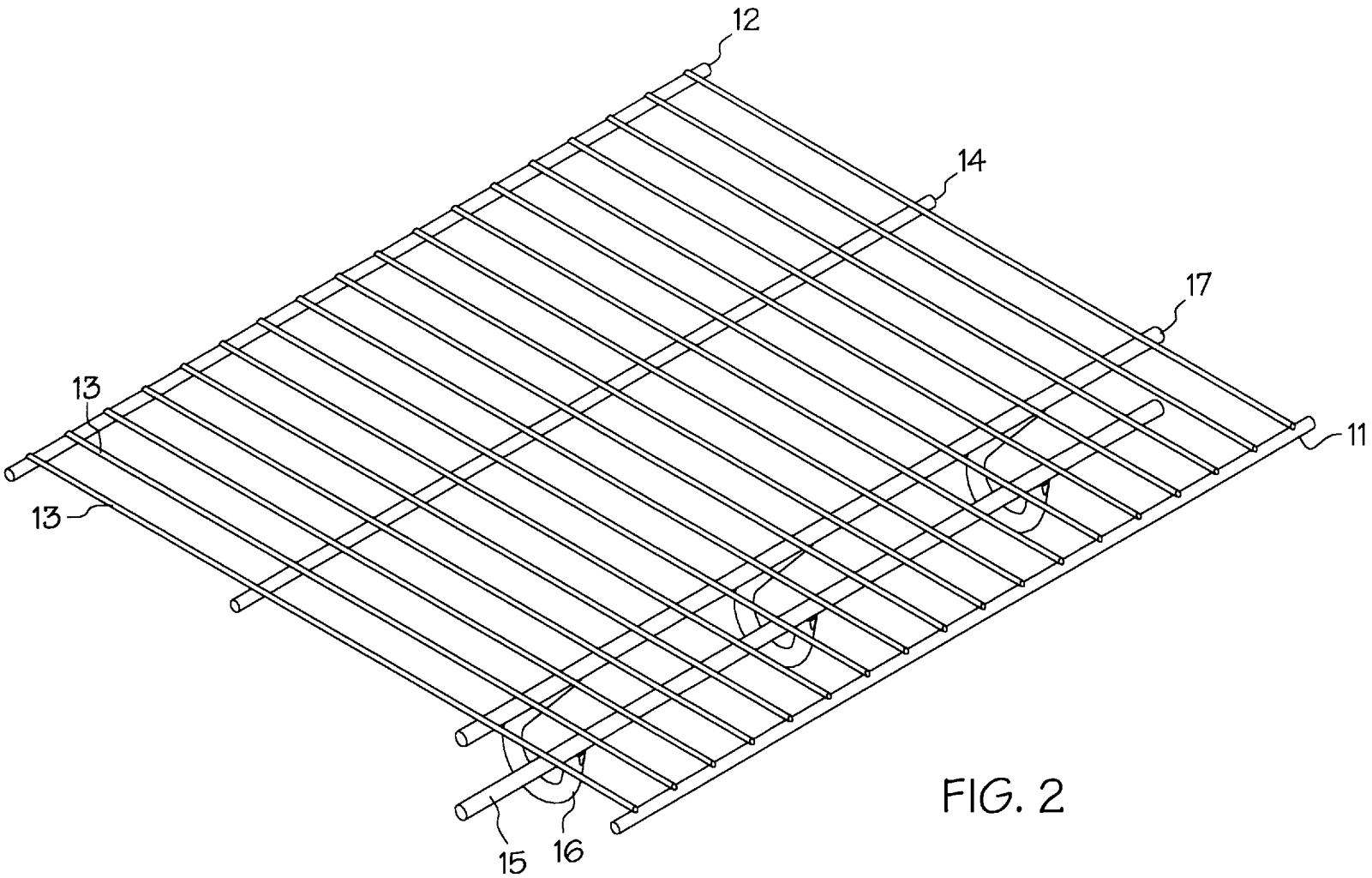
FIG. 2 is a perspective of another embodiment of the wire shelf of the present invention.

A hanger rod 15 is positioned beneath the support surface of shelf 10, and is secured to one of the longitudinally-extending support rods by means of a plurality of support hooks 16. Each of the support hooks 16 may be readily fabricated from a section of wire rod by means well-known to those skilled in the art. In the embodiment shown in FIG. 1, hanger rod 15 is secured to longitudinally-extending support rod 11 by means of a plurality of support hooks 16. Alternatively, in the embodiment shown in FIG. 2, a longitudinally extending second intermediate rod 17 is positioned parallel to and between intermediate support rod 14 and front support rod 11, and hanger rod 15 is secured thereto by means of support hooks 16. In this fashion, the hanger rod may be positioned at any location beneath the support surface of the shelf. It is also possible that multiple hanger rods may be supported beneath the support surface of the shelf in the very same manner.

Figure 3:
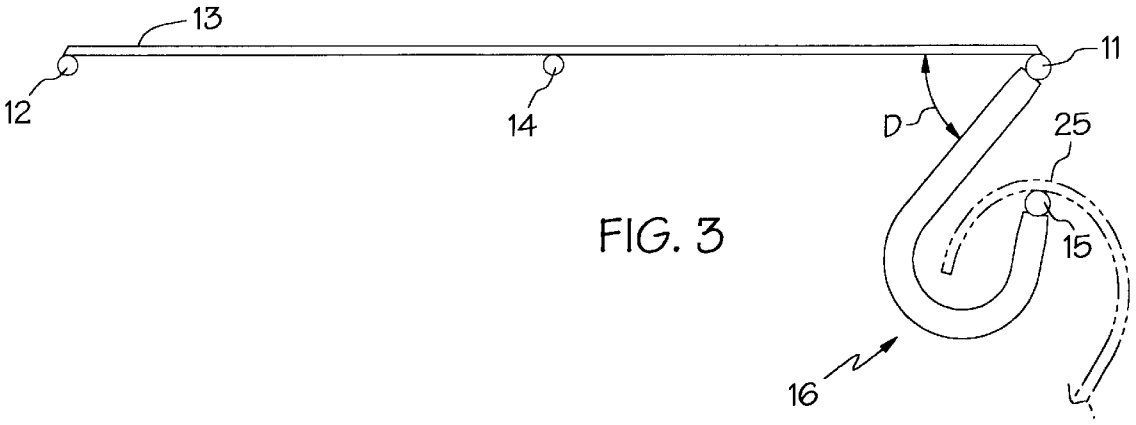
FIG. 3 is a side plan view of the wire shelf of FIG. 1.

One of the principle advantages provided by the support hooks 16 employed in the present invention is that the support hooks will not interfere with a hanger which is suspended from hanger rod 15. Thus, as best shown in FIG. 3, hook portion 25 of a clothes hanger may be slid along the entire length of hanger rod 15 without interference from support hooks 16 or any other structure of the shelf. In contrast to this, in the traditional prior art shelf design such as that shown in the '099 patent, the vertically-extending support members will interfere with hanger travel along the hanger rod.

Figure 4:
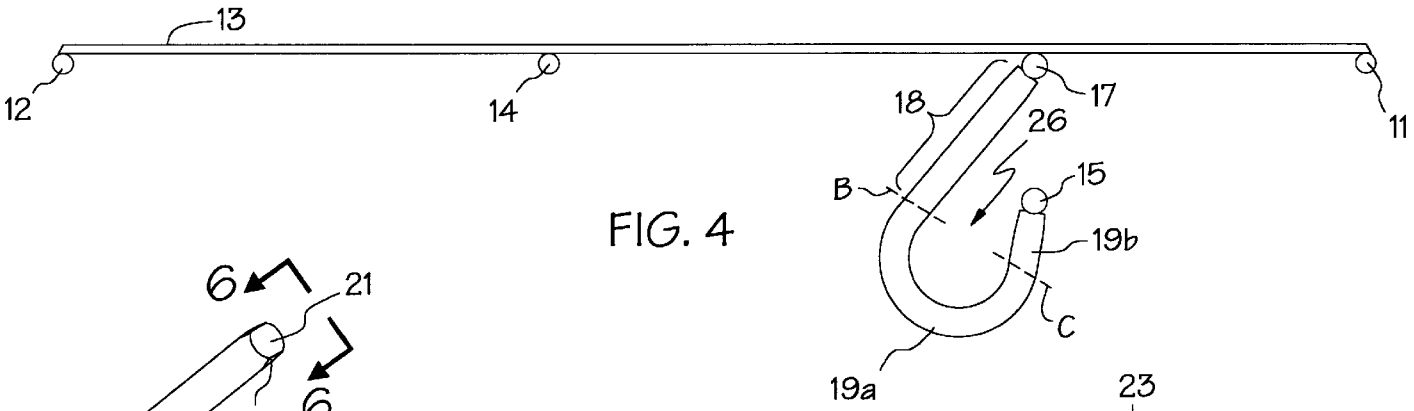
FIG. 4 is a side plan view of the wire shelf of FIG. 2.

The "continuous-slide" capability of the shelf of the present invention is dependent entirely upon the configuration of support hook 16. Thus, as best shown in FIG. 4, each support hook comprises a first portion 18 which preferably extends downwardly away from the longitudinally-extending rod to which the hook is attached. As will be understood, in order to position hanger rod 15 directly beneath the longitudinally-extending rod to which it is attached, it is preferred that first portion 18 of support hook 16 also extend rearwardly away from the front of the shelf.

In the preferred embodiment shown, first portion 18 is substantially linear, and thus the preferred orientation of first portion 18 is accomplished merely by securing upper end 21 of the support hook to the longitudinally-extending support member (1 in FIG. 3 and 17 in FIG. 4) in the proper angular orientation. When viewed in side plan with the support surface of the shelf horizontal (as shown in FIGS. 3 and 4), first portion 18 should extend away from the longitudinally-extending support rod at an angle D of less than 90 degrees (preferably, extending between the 7 and 8 o'clock positions). It should be noted that the term "upper end" refers specifically to end surface 21, which is preferably substantially flat.

Second portion 19 of support hook 16 curves towards the front of the shelf and terminates in a lower end 22 upon which the hanger rod may be secured. Alternatively, hanger rod 15 may also be welded to the support hooks immediately adjacent to said lower end. It should ne noted that the term "lower end" specifically refers to end surface 22 of support hook 16. The forward curve of second portion 19 provides a trough 26 between first portion 18 and second portion 19, and the end portion of a hanger 25 will travel within this trough without actually contacting support hook 16 (see FIG. 3). Preferably, second portion 19 comprises a substantially u-shaped portion 19*a* (extending between B and C) and straight portion 19*b*. Other configurations for second portion 19 are possible, however, with the only requirement being that a trough be provided between first portion 18 and second portion 19 for the hanger to travel in when the hanger is resting upon hanger rod 15. It is possible, however, that second portion 19 of support hook 16 comprise only a substantially u-shaped portion. The preferred embodiment however, ensures that hanger rod 15 will be positioned directly beneath, and parallel to the longitudinally-extending support rod to which it is attached (second intermediate support rod 17 in FIG. 4 and front support rod 11 in FIG. 3).

Support hooks 16 are integrally welded to the longitudinally-extending rod by conventional means. It is important, however, that upper end 21 of support hook 16 be welded to second intermediate support rod 17 (or front support rod 11 in the embodiment of FIG. 3). In other words, upper end 21 of hook 16 is welded directly to the circumferential surface of support rod 17. As more fully described below, this method of attachment differs significantly from that shown in the '072, Patent and provides significant and unexpected advantages.

Figure 6:
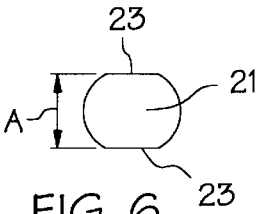
FIG. 6 is a plan view of the upper end of the hook of FIG. 5.

Because hangers containing clothes can put tremendous weight on the hanger rod of a shelf, it is critical that support hook 16, as well the manner in which it is secured to the shelf, have sufficient strength to prevent any distortion of the hook. Thus, Applicant has found that it is necessary to increase the diameter of the wire material used to manufacture hook 16. As will be apparent, however, if hook 16 is of a larger diameter than support rod 17 (or support rod 11 in FIG. 3), then an aesthetically-pleasing joint will not be accomplished and the entire surface area of upper end 21 will not be used in the weld. In order to overcome these drawbacks, Applicant has found that by crimping opposite side walls of end 21, the circumference of end 21 will more closely match the diameter of the support rod to which it is welded. Thus, as best shown in FIG. 6, a pair of flats 23 are provided on opposite sides of end 21 of hook 16. By crimping the end of support hook 16 in order to provide these flats, the distance A will be reduced so as to approximately match the diameter of support rod 17. At the same time, the sides of end 21 which remain curved will bulge outwardly as shown in FIG. 6. This will therefore provide a welding surface which is longer in the lengthwise direction of support rod 17 while also matching the diameter of support rod 17. This has the added critical advantage that no portion of end 21 is wasted, since the entire area of end 21 may now be used to for welding to support member 17. This also provides a longer beam structure, thereby increasing the strength of this weld. In addition, this allows one to use a larger gauge wire for hook 16 without detracting from the aesthetic qualities of the weld.

Figure 5:
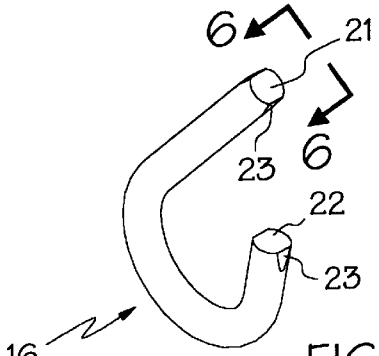
FIG. 5 is a perspective view of the support hook of the present invention.

In a similar manner, flats 23 are also provided adjacent lower end 22 of hooks 16 to which hanger rod 15 is attached (as shown in FIG. 5). This will increase the strength of this weld, and improve the overall aesthetics. It will also ensure that there are no protruding sharp edges from the ends of the support hooks which would tend to snag on clothing. Thus, hanger rod 15 may be of a smaller gauge than support hook 16, thereby saving considerable costs.

Another significant advantage of the configuration of the shelf of the present invention is that the various support brackets which have been previously developed for shelves such as that shown in the '099 (particularly the end brackets) may be employed with the shelf of the present invention. The distance between front support rod 11 and hanger rod 15 in the embodiment of FIG. 3 may be identical to that of the shelf design shown in the '099 Patent. Thus, the shelf of the present invention does not require any modifications to currently-available used brackets used for these type of wire shelves. In contrast, the '072 requires considerable modification to conventional wire shelf end brackets. This lack of interchangeably with prior art shelf designs is significant, and obviously leads to increased manufacturing costs since a bracket unique to the shelf design of the '072 Patent must be manufactured.

Another significant advantage over the shelf design of the '072 Patent is that fewer members are employed. The support hooks of the '072 Patent have an added straight vertical shank through which the support hooks are secured to an extra front flange on the shelf. Thus, the support hooks of the '072 Patent are not integral with the shelf as is the case with the present invention. To the contrary, the support hooks of the '072 Patent must be secured to a flange which is provided on the front of the shelf, and are thus merely additions to an existing wire shelf. This added flange is significant in that it requires the bending of each transversely-extending rod member. Such a configuration will therefore require additional manufacturing steps, therefore increasing the production cost. Thus, the shelf of the present invention is a significant advancement over that of the '072 Patent.

The size of the shelf of the present invention, as well as the wire members from which it is produced may vary considerably. For example, the embodiment of FIGS. 1 and 3 is typically manufactured in a 12 inch size. In other words, the distance between rear support rod 12 and front support 11 is approximately 12 inches (center to center). This size is typically appropriate for most residential closets. The shelf of FIGS. 2 and 4, on the other hand is typically provided in a 16 inch size. Thus, the distance between front support 11 and rear support rod 12 is approximately 16 inches. Second intermediate support rod 17, as well as hanger rod 15, on the other hand, are typically provided a distance of 12 inches from rear support rod 12. In this manner, hanger rod 15 will be positioned the same distance from rear support rod 12 as in the embodiment of FIG. 3, however, an additional 6 inches of support surface is provided.

Another problem noted with the shelf configuration of the '072 patent is the spacing between the hanger rod and the shelf support surface is increased. In the '072 patent, it is specified that the vertical shank of the support hooks extends downwardly about 1¼ inches. The distance between the bottom of this vertical shank and the hanger rod is maintained at the traditional distance of about 1 5/16 inches. Because of the presence of this added vertical flange, however, the hanger rod of the '072 patent is in reality positioned a greater distance from the shelf support surface. Although this distance seems small, it can be significant when a consumer wishes to place two of these shelves (one on top of the other) in a standard sized closet. The spacing between the two shelving units must be increased in order to account for this added vertical flange, and therefore oftentimes either clothes hanging on the lower shelf will drag on the floor or there will be insufficient space between the support surface of the upper shelf's support surface and the ceiling of the closet. The present Applicants have discovered, among other things, a way to eliminate this vertical flange, thereby returning the distance between the hanger rod and the support surface to its more traditional dimensions.

As for the size of the wires, it is preferred that transverse rod member 13 be between about 13 and about 11 gauge wire (between about 0.09 and 0.12 inches in diameter). The longitudinally-extending rods, other than the rod from which hanger rod 15 is secured, are preferably between about 4 gauge (0.225 inches) and about ¼ inch in diameter. The longitudinally-extending rod to which hanger rod 15 is attached (11 in FIG. 3 and 17 in FIG. 4), as well as hanger rod 15 itself, is preferably of a slightly large gauge, namely between about 9/32 and about 5/16 inches in diameter. Support hook 16 is preferably of an even slightly large gauge, namely between about 0.34 and about 0.38 inches in diameter. Finally, when these approximate wire gauges are employed for the various members of the present invention, it is preferable that the support hooks be placed approximately 6 inches from one another. This is in contrast to the prior art shelf designs wherein the hanger rod supports were almost always positioned 12 inches from each other.

The foregoing description of preferred embodiments is by no means exhaustive of the variations in the present invention that are possible, and has been presented only for purposes of illustration and description. Obvious modifications and variations will be apparent to those skilled in the art in light of the teachings of the foregoing description without departing from the scope of this invention. Thus, it is intended that the scope of the present invention be defined by the claims appended hereto.

What we claimed is:

1. A wire shelf having a hanger rod which permits uninterrupted hanger travel along its length, said shelf comprising:

(a) a plurality of parallel, transversely-extending rod members, each having a rear end and a forward end, said transversely-extending rod members providing a support surface and said forward end of said members positioned at a forward edge of said shelf;

(b) a longitudinally-extending rear support rod secured to the rear end of each of said transversely-extending rod members;

(c) a longitudinally-extending front support rod secured to the forward end of each of said transversely-extending rod members;

(d) at least one longitudinally-extending intermediate support rod positioned parallel to said front and rear support rods, and secured to said transversely-extending rod members;

(e) a plurality of support hooks shaped from a wire rod, said support hooks secured to one of said front support rod and said at least one intermediate support rod, each of said support hooks having an end surface, an outer surface and a lower end, said end surface secured directly to the outer circumference of one of said front support rod and said at least one intermediate support rod; and (f) a hanger rod secured to said support hooks at or adjacent to said lower end of the support hooks;

wherein said support hooks are configured so as to position said hanger rod beneath the plane of said support surface, and such that the hook portion of a clothes hanger may be slid along the length of said hanger rod without obstruction from said support hooks.

2. The wire shelf of claim 1, wherein said transversely-extending rod members, said support rods, said support hooks and said hanger rod are secured to one another by welding.

3. The wire shelf of claim 2, wherein said support hooks each comprise a first portion which extends downwardly away from the support rod to which it is welded, and a second portion which curves towards the forward edge of said shelf and terminates in said lower end, such that said first and second portions of said support hooks provide a trough within which the end of the hook portion of a hanger resting on said hanger rod will travel when the hanger is slid along the length of said hanger rod.

4. The wire shelf of claim 3, wherein said first portion of said support hooks extends downwardly and rearwardly away from the support rod to which it is welded, and wherein said hanger rod is positioned parallel to and substantially directly beneath the support rod to which said hooks are welded.

5. The wire shelf of claim 4, wherein said support hooks are welded to said front support rod.

6. The wire shelf of claim 4, wherein said support hooks are welded to said intermediate support rod.

7. The wire shelf of claim 4, wherein a pair of parallel flats are provided on opposite sides of the circumference of each of said support hooks adjacent said end surface such that the distance across said end surface at said flats is approximately equal to or less than the diameter of the support rod to which said end surface is welded.

8. The wire shelf of claim 7, wherein a pair of parallel flats are provided on opposite sides of the circumference of each of said support hooks adjacent said lower end such that the distance across said lower end at said flats is approximately equal to or less than the diameter of said hanger rod, and wherein the lower end of said support hooks is welded directly to the outer circumference of said hanger rod.

9. The wire shelf of claim 7, wherein the diameter of said support hooks is greater than the diameter of the support rod to which said end surface is welded.

10. The wire shelf of claim 7, wherein the distance between said hanger rod and the support rod to which it is secured is between about 1¼ inches and about 1⅝ inches.

11. The wire shelf of claim 10, wherein the diameter of said transversely-extending rod members is between about 0.09 and 0.12 inches, the support rods, other than the support rod to which said support hooks are welded, have a diameter of between about 0.22 inches and about 0.25 inches, the diameter of the support rod to which the support hooks are welded and said hanger rod are both between about 9/32 inches and about 5/16 inches in diameter, and said support hooks have a diameter of between about 0.34 and about 0.38 inches in diameter.

12. The wire shelf of claim 11, wherein the distance between adjacent support hooks is less than 9 inches.

13. A wire shelf having a hanger rod which permits uninterrupted hanger travel along its length, said shelf comprising:

(a) a plurality of parallel, transversely-extending rod members, each having a rear end and a forward end, said transversely-extending rod members providing a support surface and said forward end of said members positioned at a forward edge of said shelf;

(b) a longitudinally-extending rear support rod secured to the rear end of each of said transversely-extending rod members;

(c) a longitudinally-extending front support rod secured to the forward end of each of said transversely-extending rod members;

(d) at least one longitudinally-extending intermediate support rod positioned parallel to said front and rear support rods, and secured to said transversely-extending rod members between said front and rear support rods;

(e) a plurality of support hooks shaped from a wire rod, each of said support hooks comprising:

a first portion secured solely to one of said longitudinally-extending support rods, said first portion extending downwardly and rearwardly away from said one of said longitudinally-extending support rods;

a second portion which curves towards the forward edge of said shelf and terminates in a lower end; and (f) a hanger rod secured to said second portion of said support hooks; wherein said support hooks are configured so as to position said hanger rod beneath the plane of said support surface, and wherein said first and second portions of said support hooks provide a trough within which the end of the hook portion of a hanger resting on said hanger rod will travel when the hanger is slid along the length of said hanger rod, thereby permitting the hook portion of a clothes hanger to be slid along the length of said hanger rod without obstruction from said support hooks.

14. The wire shelf of claim 13, wherein said support hooks are welded to said front support rod.

15. The wire shelf of claim 13, wherein said support hooks are welded to said intermediate support rod.

16. The wire shelf of claim 15, further comprising a second longitudinally-extending intermediate support rod positioned parallel to said front and rear support rods, and secured to said transversely-extending rod members between said rear support rod and said at least one intermediate support rod.

17. A wire shelf having a hanger rod which permits uninterrupted hanger travel along its length, said shelf comprising:

(a) a plurality of parallel, transversely-extending rod members, each having a rear end and a forward end, said transversely-extending rod members providing a support surface and said forward end of said members positioned at a forward edge of said shelf;

(b) a longitudinally-extending rear support rod secured to the rear end of each of said transversely-extending rod members;

(c) a longitudinally-extending front support rod secured to the forward end of each of said transversely-extending rod members; and (d) a plurality of support hooks shaped from a wire rod for supporting a hanger rod which can support a plurality of hangers having clothes, each of said support hooks comprising:

a first portion secured solely to, and extending downwardly and rearwardly away from said front support rod;

a second portion which curves towards the forward edge of said shelf and terminates in a lower end; and (e) said hanger rod being secured to said second portion of said support hooks; wherein said support hooks are configured so as to position said hanger rod beneath the plane of said support surface, and wherein said first and second portions of said support hooks provide a trough within which the end of the hook portion of a hanger resting on hanger rod will travel when the hanger is slid along the length of said hanger rod, thereby permitting the hook portion of a clothes hanger to be slid along the length of said hanger rod without obstruction from said support hooks.

18. The wire shelf of claim 1, wherein said end surface is substantially flat.

19. A wire shelf having a hanger rod which permits uninterrupted hanger travel along its length, said shelf comprising:

(a) a plurality of parallel, transversely-extending rod members, each having a rear end and a forward end, said transversely-extending rod members providing a support surface and said forward end of said members positioned at a forward edge of said shelf;

(b) a longitudinally-extending rear support rod secured to the rear end of each of said transversely-extending rod members;

(c) a longitudinally-extending front support rod secured to the forward end of each of said transversely-extending rod members;

(d) at least one longitudinally-extending intermediate support rod positioned parallel to said front and rear support rods, and secured to said transversely-extending rod members;

(e) a plurality of support hooks shaped from a wire rod, said support hooks secured to one of said front support rod and said at least one intermediate support rod, each of said support hooks having an end surface and a lower end, said end surface secured directly to the outer circumference of one of said front support rod and said at least one intermediate support rod; and (f) a hanger rod secured to said support hooks at or adjacent to said lower end of the support hooks;

wherein said support hooks are configured so as to position said hanger rod beneath the plane of said support surface, and such that the hook portion of a clothes hanger may be slid along the length of said hanger rod without obstruction from said support hooks;

said transversely-extending rod members, said support rods, said support hooks and said hanger rod being secured to one another by welding;

said support hooks each comprising a first portion which extends downwardly and rearwardly away from the support rod to which it is welded, and a second portion which curves towards the forward edge of said shelf and terminates in said lower end, such that said first and second portions of said support hooks provide a trough within which the end of the hook portion of a hanger resting on said rod will travel when the hanger is slid along the length of said hanger rod;

wherein said hanger rod is positioned parallel to and substantially directly beneath the support rod to which said hooks are welded; and a pair of parallel flats are provided on opposite sides of the circumference of each of said support hooks adjacent said upper end such that the distance across said upper end at said flats is approximately equal to or less than the diameter of the support rod to which said upper end is welded.

20. The wire shelf of claim 19, wherein a pair of parallel flats are provided on opposite sides of the circumference of each of said support hooks adjacent said lower end such that the distance across said lower end at said flats is approximately equal to or less than the diameter of said hanger rod, and wherein the lower end of said support hooks is welded directly to the outer circumference of said hanger rod.

21. The wire shelf of claim 19, wherein the diameter of said support hooks is greater than the diameter of the support rod to which said upper end is welded.

22. The wire shelf of claim 19, wherein the distance between said hanger rod and the support rod to which it is secured is between about 1¼ inches and about 1⅝ inches.

23. The wire shelf of claim 22, wherein the diameter of said transversely-extending rod members is between about 0.09 and 0.12 inches, the support rods, other than the support rod to which said support hooks are welded, have a diameter of between about 0.22 inches and about 0.25 inches, the diameter of the support rod to which the support hooks are welded and said hanger rod are both between about 9/32 inches and about 5/16 inches in diameter, and said support hooks have a diameter of between about 0.34 and about 0.38 inches in diameter.

24. The wire shelf of claim 23, wherein the distance between adjacent support hooks is less than 9 inches.

* * * * *